US005667089A

United States Patent [19]

Moore

[11] Patent Number: 5,667,089

[45] Date of Patent: Sep. 16, 1997

[54] CLOSURE HAVING A WRAP-AROUND SEAL

[75] Inventor: David N. Moore, Plainfield, Ill.

[73] Assignee: Phoenix Closures, Inc., Naperville, Ill.

[21] Appl. No.: 646,478

[22] Filed: May 8, 1996

Related U.S. Application Data

[63] Continuation of Ser. No. 508,404, Jul. 31, 1995, abandoned, which is a continuation of Ser. No. 217,479, Mar. 23, 1994, abandoned.

[51] Int. Cl.[6] ..... B65D 53/04

[52] U.S. Cl. ..... 215/351; 215/DIG. 1

[58] Field of Search ..... 215/316, 341, 215/349–351, 353, 354, DIG. 1, 344; 220/308, 358, 378, 304

[56] References Cited

U.S. PATENT DOCUMENTS

| | | | |
|---|---|---|---|
| 883,259 | 3/1908 | Tueckmantel | 215/349 X |
| 910,128 | 1/1909 | Hammer . | |
| 2,026,889 | 1/1936 | Gray et al. | 215/351 X |
| 2,130,746 | 9/1938 | Scofield | 215/350 |
| 2,818,204 | 12/1957 | Henchert et al. | 215/DIG. 1 X |
| 3,207,350 | 9/1965 | Hagmann et al. | 215/351 X |
| 3,489,307 | 1/1970 | Wenger | 215/351 X |
| 4,276,989 | 7/1981 | Hicks | 215/341 X |
| 4,331,249 | 5/1982 | Banich, Sr. | 215/343 |
| 4,462,502 | 7/1984 | Luenser et al. . | |
| 4,531,649 | 7/1985 | Shull | 215/DIG. 1 X |
| 4,564,117 | 1/1986 | Herbert . | |
| 4,570,811 | 2/1986 | Lecinski et al. | 215/343 |
| 4,576,297 | 3/1986 | Larson | 215/350 X |
| 4,717,034 | 1/1988 | Mumford | 215/350 X |
| 5,078,290 | 1/1992 | Ochs . | |
| 5,184,746 | 2/1993 | Moore et al. . | |
| 5,197,621 | 3/1993 | Bartl et al. | 215/351 X |

*Primary Examiner*—Allan N. Shoap
*Assistant Examiner*—Nathan Newhouse
*Attorney, Agent, or Firm*—Welsh & Katz, Ltd.

[57] ABSTRACT

A closure having an inner retaining area for receiving a closure liner. The liner circumferentially contacts the land surface of the container to cover the mouth of the container upon application of the closure to the container. A well, formed around the outer peripheral edge on the inside of the closure is dimensioned to receive the land surface of the closure. The well includes an upper surface having integrally depending flexible teeth. The walls of the well together with the teeth provide a directional force against the liner causing the liner to wrap around the land surface to increase the amount of liner to land surface contact and thereby counter the effects of irregularities on the land surface. The teeth also provide a localized compression force down against the liner to further increase the sealing contact between the liner and the land surface.

4 Claims, 2 Drawing Sheets

CLOSURE HAVING A WRAP-AROUND SEAL

This is a continuation application of Ser. No. 08/508,404, filed Jul. 31, 1995, now abandoned, which is a continuation application of Ser. No. 08/217,479, filed Mar. 23, 1994, now abandoned.

The present invention relates to closures for containers which use sealing liners and, more specifically, to a closure having a well with a series of teeth and grooves which provide a more positive seal between the liner and the container land area.

BACKGROUND OF THE INVENTION

In the bottling industry, economic and environmental concerns are a constant incentive behind the manufacture of closure and liner systems that are inexpensive and as environmentally correct as possible. Both closures and liners are being made thinner, which results in problems that were not a concern with previously available closure and liner systems. Particularly, when using thinner structures, the compressibility that thicker materials offer is lost and, consequently, a greater percentage of non-seals result. The molding processes and the particular plastics used to form containers are rarely consistent and irregularities on the land of the container can be common. Therefore, thinner, less compressible liners and irregularities on the container land may prevent a proper, total seal of the liner to the container land.

If the seal between a given liner and the container land is inadequate, the container contents may spoil, lose its freshness and become unmarketable. Further, because a properly sealed liner generally performs a tamper-indicating function, an improper seal may be viewed by the consumer as an attempt at container tampering.

Therefore, there is a need for a closure which incorporates a structure that will compensate for the use of a thin liner and closure construction and irregularities on the container land. The closure should provide wrap-around liner contact with the container land. The closure must perform this task without increased expense and without raising environmental concerns that the thinner closures and liners are designed to solve.

SUMMARY OF THE INVENTION

Accordingly, it is an object of the present invention to provide a closure having an internal structure that will allow for a more positive seal between the closure, the liner and the container land.

It is another object of the present invention to provide a closure and liner system that will cause a wrap-around effect between the liner and the container land to counter the effects associated with thinner liners and irregular container lands.

In accordance with the present invention, all of these objects, as well as others not herein specifically identified, are achieved generally by the present closure having a well and a series of teeth and grooves, wherein the well receives the container land and provides liner to land contact through a higher degree of rotation while the teeth and grooves provide a compression feature.

More specifically, the present invention includes a closure for use with a typical container having a land. The closure includes a well formed on the inside of the closure and is defined by an outer wall of the closure top panel and the inside surface of the closure annular depending skirt. The well must be sufficiently wide and deep to accept the given thickness of the liner and the container land. The teeth and corresponding grooves are integrally formed with the closure and depend from the upper portion of the well. A liner is either glued to or frictionally fit within the closure. The liner can be oversized such that upon application of the closure to the container the liner more positively wraps around both the inside and outside edges of the container land. Thus, in the preferred embodiment, the liner contacts the land along three sides, the top and the two edges of the land. The well provides a higher degree of possible rotation of the closure onto the container causing a wrap-around effect at low torque, while the teeth provide compression down against the liner between the liner and the container land.

BRIEF DESCRIPTION OF THE DRAWINGS

Further objects of the invention, taken together with additional features contributing thereto and advantages occurring therefrom, will be apparent from the following description of the invention when read in conjunction with the accompanying drawings, wherein:

FIG. 3(*a*) is a partial sectional view of the present closure and liner with a pull tab applied to a container;

DETAILED DESCRIPTION OF THE INVENTION

Figure 1:
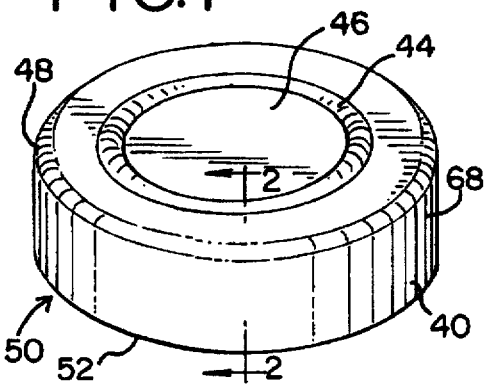
FIG. 1 is a perspective view depicting the outside surfaces of the present closure.

In the drawings, FIGS. 1–4, wherein a preferred embodiment of the invention is shown, and wherein similar reference characters designate corresponding parts throughout the several views, 10 generally designates the present closure assembly. The closure assembly 10 is designed for use with any type of container 12 used for storing and dispensing powder, liquid or other types of substances. Although a specific type of container is not required for assembly of the present closure 10, it is contemplated that the container 12 will include a container neck 14 which may include external threading 16 designed to engage complementary threading on the inside surface of the given closure cap 40. The neck 14 terminates at an upper end 18 which defines a container mouth 22 having a substantially flat land surface 24.

A protective liner 30 includes a two-sided panel which when applied to the container 12 covers the mouth 22. The liner 30 includes a lower surface 32, which actually contacts the land 24 along the peripheral edge 34 of the liner 30. The liner 30 also includes an upper surface 36 which is directed away from the container 12 and generally contacts the ceiling of the given cap. To reduce costs and address environmental concerns, the liner 30 will generally be thinner than those used heretofore. Because it is thinner, the liner 30 will generally be more flexible and pliant than previously used liners. The liner 30 can be formed having at least its lower surface 32 made of a foil material, such as those normally used for peel-away sealing liners. The liner 30 can be made of polypropylene, polyethylene or paper materials.

Figure 2:
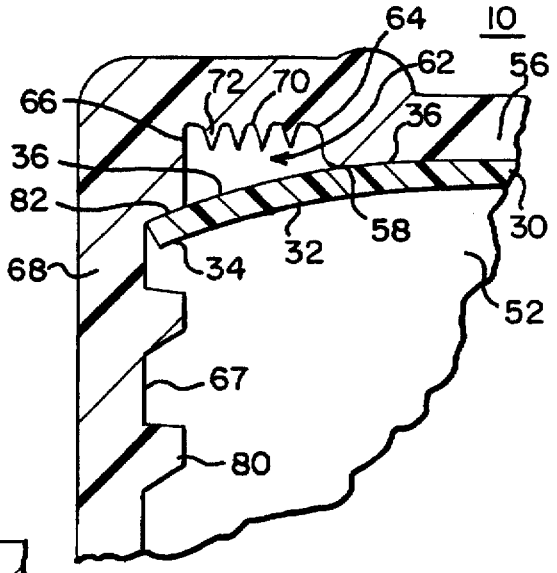
FIG. 2 is a partial sectional view of the present closure with an oversized liner prior to application to a container.
Figure 3:
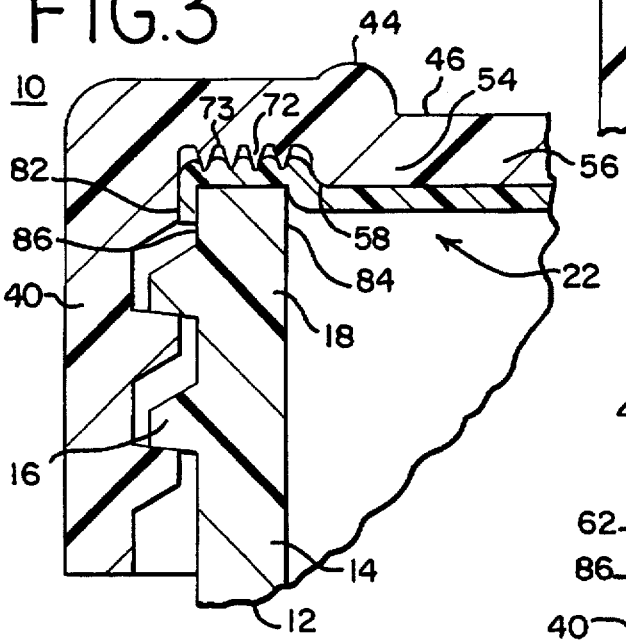
FIG. 3 is a partial sectional view of the present closure and liner of FIG. 1 after application to the container.

Referring more specifically to FIGS. 2 and 3 in the preferred embodiment of the closure and liner assembly 10, a closure 40 includes a top panel 42 which is defined by a peripheral ridge 44 and indentation 46 and a substantially rounded outer edge 48. However, it is contemplated that the closure 40 may take on various alternative configurations, particularly on the outside of the closure 40. The particular configuration of the outside 50 of the closure 40 is primarily dependent on the specific application to which the present invention 10 will be applied, and more particularly, to the specific type of capping machinery utilized. As such, the top panel 42 need not include the peripheral ridge 44 or the indentation 46 or the rounded outer edge 48. Because the liner 30 is secured up within the closure 40, it is contemplated that the present invention can be stored, sold and shipped as a package to the bottler.

Figure 4:
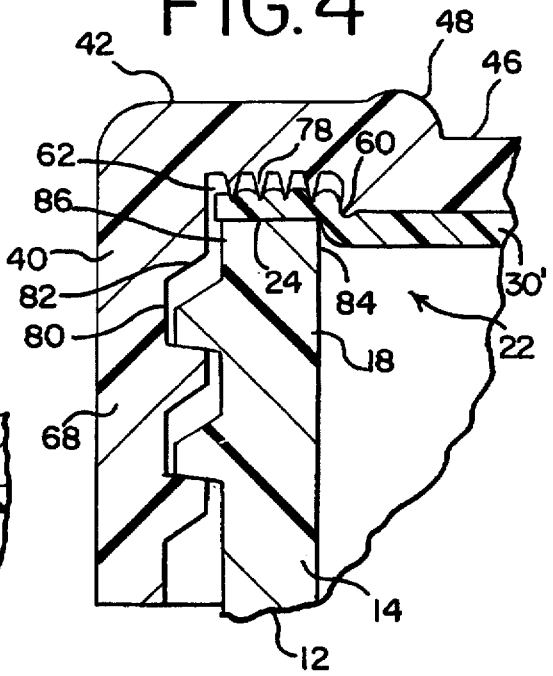
FIG. 4 is a partial sectional view of the preferred embodiment of the present closure with a regular sized liner applied to a container.
Figure 3A:
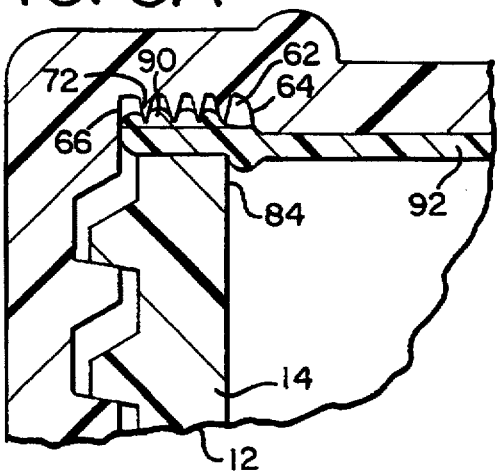
Figure 6:
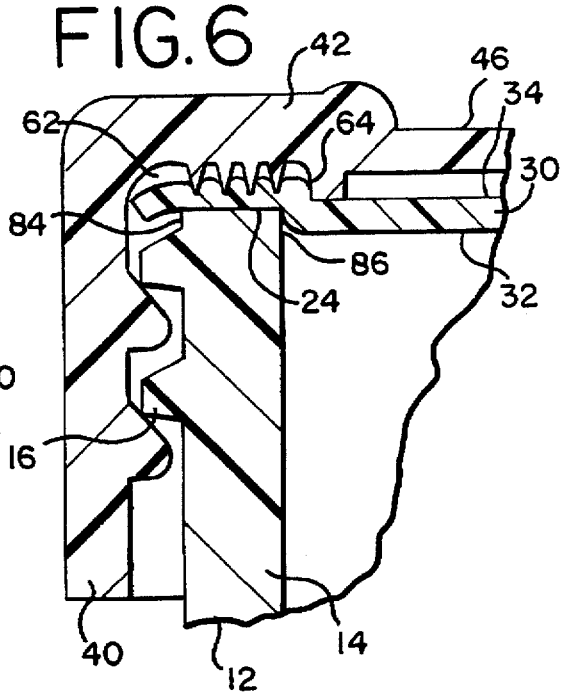
FIG. 6 is a partial sectional view of another alternative embodiment of the present closure with an oversized liner applied to a container.
Figure 7A:
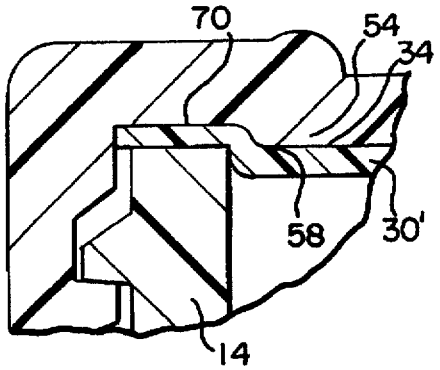
FIGS. 7(*a*)–(*c*) depict partial sectional views of alternative embodiments of the well and teeth/groove formations of the present invention.
Figure 7B:
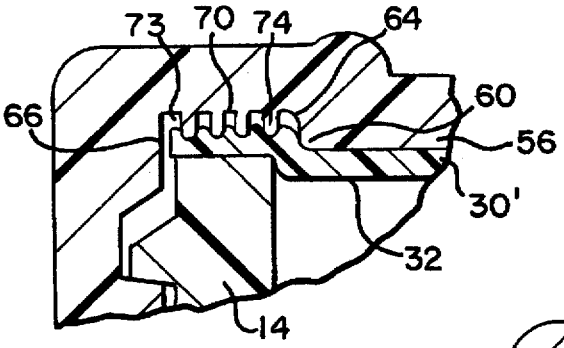
Figure 7C:
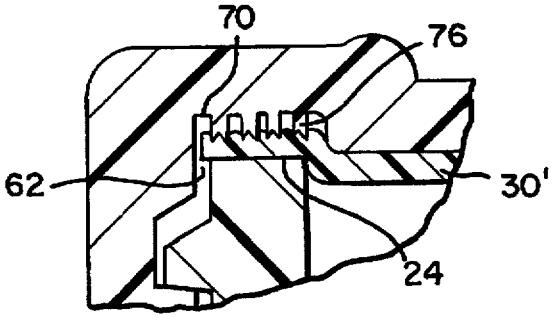

As the invention is directed more specifically to the function of providing a more positive seal between the liner 30 and the container land 24, the configuration of the inside 52 of the closure 40 is important. With reference to FIGS. 2–4, it is shown that the top panel 40 has an inside surface 54 having a downwardly projecting center ceiling 56. The center ceiling 56 functions to push the liner 30 down against the container land 24, and as shown in the figures, actually extends the liner 30 down into the container mouth 22. The ceiling 56 generally takes on the shape of the closure 40, in most situations that shape will be that of a circle. The outer edge 58 of the center ceiling 56 can be substantially rounded as shown in FIG. 2, or include an integral bead-like shape 60 as shown in FIG. 4. Further, it is contemplated that the outer edge 58 of the ceiling 56 may protrude at an angle whose plane cuts diagonally through the container neck 14, as shown in FIG. 6.

As shown throughout the several views, and specifically referring to FIGS. 2–7, the present invention 10 includes an annular channel or well 62 located on the inside 52 of the closure 40. The well 62 is defined by an inner wall 64 and an outside wall 66. The outside wall 66 is actually the upper portion of the inside surface 67 of the annular skirt 68 which is integral with and depends down from the top panel 42, particularly ridge 44. The well 62 will typically be formed around the entire circumference of the closure 40, but it is contemplated that for certain applications other configurations will work more effectively. The well 62 also includes an upper surface 70, which can be substantially flat, but preferably includes teeth 72 having grooves 73 formed therebetween. As shown in FIGS. 1–6 the teeth 72 are preferably "V" shaped. It is contemplated that the teeth 72 can take on various other configurations, and those which are particularly contemplated are rounded or "U" shaped teeth 74 (FIG. 7*b*) and a generally "W" shaped teeth 76 (FIG. 7*c*). The W-shaped teeth 76 provide twice as many contact points 78 then do the V-shaped teeth 72, which may be beneficial in certain applications where more contact points are necessary to insure a positive seal of the liner 30 against the container land 24. It is also contemplated that the well 62 may be formed without any teeth formations whatsoever (FIG. 7*a*).

Continuing reference to FIGS. 2 and 3, there it is shown that the liner 30 is preferably cut to be oversized. In other words, the diameter of the liner 30 is larger than the diameter of the inside 52 of the closure 40 as measured from diametrically opposed points along the outer wall 68 of the well 62. As shown in FIG. 2, the oversized liner 30 allows the liner 30 to frictionally fit up within the closure 40, thereby eliminating the need for adhering the liner 30 to the inside surface 54 of the top panel 42. Additionally, the threading 80 of the closure 40 will help retain the liner 30 up within the closure 40 prior to application of the closure and liner assembly 10 to the container 12.

Referring to FIG. 4, the inventive closure and liner assembly 10 utilizes the well 62 on the closure, above the liner, to receive the land 24 of the container 12 and provide a wrap-around liner contact, at low torques, prior to utilizing the compression of the liner 30 and the closure 12 compression features at higher torques. The invention provides liner 30 to land 24 contact through a higher degree of rotation of the closure than can a liner 30 by itself. The closure compression features, described above as the teeth 72, distort or flex when the land 24 of the container 12 presses against them vertically as torque is applied to the closure 40. The teeth 72, therefore, push down against the liner 30 in substantially a vertical alignment with the land 24 of the container 12. To this end, it is important to realize that the well 62 must be located within the closure 40 so as to substantially align or compliment the location and width of the land 24.

Shown in FIGS. 3, 4, 5 and 6, upon application of the closure assembly 10 onto a container 12, such as by screwing or snapping the given closure cap, the container land 24 of the container 12 and the closure 40 are brought together whereby the closure 40 is forced down onto or towards the container mouth 22 and land 24. As the closure 40 is brought down closer to the container 12, the liner 30 is compressed between the land 24 and the well 62, and more particularly between the teeth 72, the outer edge 58 of the ceiling 56, and the wedge-like upper end 82 of the threading 80 of the closure 40.

Viewing FIGS. 2 and 3 in sequence, there is shown in FIG. 2 an oversized liner 30 having diameter which is greater than diameter, such that the liner 30 extends over and beyond the well 62 while positioned within the closure 40 prior to application to the container 12. Thereafter, in FIG. 3, upon application of the liner 30 and closure 40 to the container 12, the well 62 accepts or receives a portion of the container neck 14, most clearly the upper portion or land 24, and as torque is applied to the closure 40 the teeth 72 provide a vertical compression on the liner 30 and against the land 24 to insure a positive seal of liner 30 against land 24.

The oversized liner 30 can also provide an anti-backoff function, since it provides a buttress against which the container neck 14 and the inner wall 64 or the inside surface 67 of the annular skirt 68 abut. The liner acts as a gap filler and frictional surface between the inside surface 67 and the neck 14 which lessens the possibility of the closure 40 backing off the container 12 that often results from vibrations and movements during shipping and handling.

As shown in FIG. 3, the center ceiling 56 and more particularly the corner 58 of ceiling 56 pushes down against the liner 30, causing the liner 30 to wrap around the inside wall 84 of the container neck 14 at the land 24 of the container 12. Similarly, the upper end 82 of the inside surface 67 of closure 40 pushes down against the liner 30, thereby causing the liner 30 to wrap around the outer wall 86 of the container neck 14 along the land 24 of container 12. Upon full application of the closure 40 and liner 30 onto the container 12, the inventive structure of the closure 40, namely the well 62 and teeth 72, insure a positive seal of liner 30 to the container 12. The teeth 72 not only provide a vertical or downward force against the liner 30, but also help to prevent slippage or crimpage of the liner 30 after application to the container 12.

Because the well 62 receives a portion of the neck 14, particularly the land 24, it allows the ceiling 56 to push the liner 30 further down towards or into the mouth 22 while the teeth 72 provide a localized downwards compression of the liner 30 against the land 24. In short, the walls 64 and 66 of the well 62 push the liner 30 down around the sidewalls 84 and 86 of the land 24, while the teeth 72 compress the liner 30 into a sealing position down against the land 24 causing an enveloping sealing effect.

Figure 5:
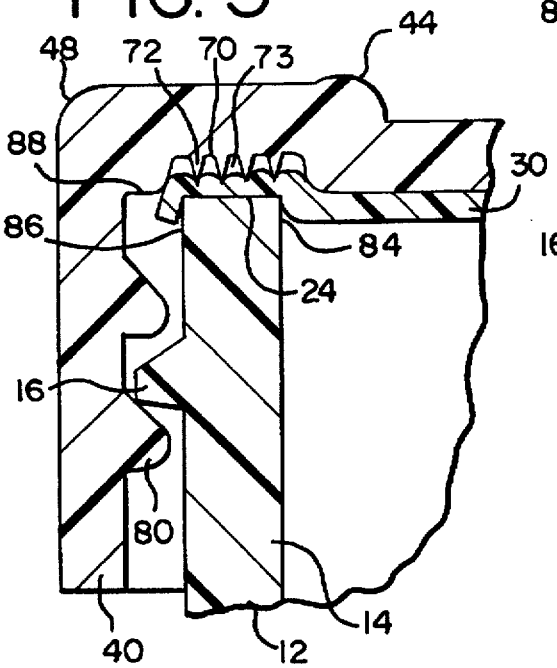
FIG. 5 is a partial sectional view of another alternative embodiment of the present closure with an oversized liner applied to a container.

FIG. 4 shows the present invention in use with a regular sized liner 30'. As such, the, liner 30' does not wrap around the land 24 as thoroughly as in the preferred embodiment depicted in FIG. 3. Particularly, the liner 30' does not wrap or extend over the outer wall 86 of the land 24. However, it is contemplated that for most applications of the present invention, the liner 30' which does wrap around the inner wall 84 of the land 24 and is compressed by finger 72, will provide a sufficient amount of seal between the closure 40 and container 12 to prevent leakage, spoilage and the like. In FIG. 5 there is shown another alternative version of the well 62 wherein the outer wall 66 of the well 62 is rounded, or includes a bead-like formation 88 that pushes down against the liner 30 to force the liner 30 down against the land 24 causing it to wrap around the outer wall 86. Shown in FIG. 6 is yet another alternative embodiment of the present invention in which the outer wall 66 of the well 62 as shown in FIGS. 2–4 is eliminated and the inner wall 64 of the well 62 is substantially vertical.

Accordingly, when using thin structure natural or synthetic backed heat induction or conduction type liners, the present closure assembly 10 causes additional land contact because of the above described wrap around effect between the liner 30 and the land 24. Because of the additional land contact caused by the well 62 and depending teeth 72, the present invention improves the top contact potential against the land 24 and when, in locations, where top contact is impossible, the present invention improves the chances to seal the container 12 in those locations by causing inside and outside land area contact between the liner 30 and the container land 24.

Furthermore, when using thin structured liners that get glue bonded to the land area, the present closure assembly 10 will improve the liner 30 to land 24 contact causing a stronger seal therebetween. It should be appreciated, that the present invention 10 also causes the glue to spread thinner and more evenly between the liner 30 and the land 24, thereby causing quicker glue drying time. The closure compression feature, namely the teeth 72, provide an improved seal when the land adhered liner is removed and disposed of, making the cap recyclable. Finally, when using non-adhered type liners, the present invention 10 allows for the use of thinner liners because the well 62 feature substitutes for the thicker and more compressible liner by receiving the land 24 and causing the liner to be wrapped around the land 24 area, much like a thicker liner does when under compression in presently used closer and liner assemblies.

With reference to FIG. 3(*a*), it has also been discovered that the present liner and closure assembly 10 achieves an additional advantage when using thin structure type lining materials which includes a tab 90 that gets folded over the top of the liner 92, as typically used in heat induction applications. The tab 90 is a means for the user to grip the liner 92 in order to pull and remove it from the container. Sealing tabbed liners 92 can be difficult without a compressible backup liner due to the double thickness at the location of the tab folded onto the liner 92 over the land 24 area. Without a backup liner, the seals normally leak along the edges of the tab 90. Accordingly, the present invention 10 will cause liner contact on the inside and outside 84 and 86 of the container land 24, including the area around which the tab 90 is located, without the need to use a compressible backup liner. Thereby the need for a costly secondary liner is eliminated in those cases where no liner is needed in the cap for sealing the product after the consumer has removed the peel-away liner 92 from the container land 24. Accordingly, by using the present invention, the peel-away type sealing liners can be used without a secondary compressible backup liner, which dramatically reduces costs and assembly time.

Thus, it is apparent that there has been provided, in accordance with the present invention, a liner and closure assembly 10 that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to enhance all such alternatives, modifications and variations as set forth within the spirit and broad scope of the appended claims.

What is claimed is:

1. A plastic closure for use with a container having a neck with an annular lip at an uppermost end of the neck defining a mouth having a land surface, said closure comprising:

a top panel, an annular skin depending peripherally from said top panel and means for releasably engaging said neck of said container;

an inner retaining area defined by an inner ceiling surface of said top panel and an inner surface of said annular skirt, said retaining area receiving a pliant, oversized heat induction actuated closure liner, said liner circumferentially contacting said land surface of said container to completely cover said mouth of said container;

a well defined by an upper end of said inner surface of said annular skirt, said inner ceiling surface of said top panel, an upper surface, an inner wall and an outer wall, said well having a sufficient depth and a complementary dimension to receive said land surface upon application of said closure onto said container and thereby cause said liner to sealingly contact said land surface;

a plurality of symmetrical, substantially identical, continuous, annular, flexible tooth-like elements depending from, and extending inwardly of said upper surface of said well, said tooth-like elements defining a plurality of annular gaps between their respective adjacent tooth-like elements, each said gap defining a non-liner containing region when said liner is non-compressively positioned in said closure, said tooth-like elements and their respective adjacent gaps defining a plurality of successive liner compression and liner expansion regions adapted to permit said liner to expand within said gaps as it is compressed between said land surface and said compression regions during engagement of said closure with the container to permit penetration of said container neck into said well;

a first annular bead formation along said inner wall of said well providing a directional force down against said oversized liner to extend said oversized liner down and around an inner surface of said mouth of said container, effecting a localized, positive seal between said liner and said land surface; and a second annular bead formation along said outer wall of said well providing directional force down against said oversized liner along an outer surface of said mouth, causing a complete wrap-around seal between said liner and said land surface.

2. The plastic closure of claim 1 wherein said tooth-like elements have a generally triangular cross-section.

3. The plastic closure of claim 1 wherein said tooth-like elements have a generally prolate cross-section.

4. The plastic closure of claim 1 wherein said tooth-like elements have a generally bifurcated cross-section.

* * * * *

UNITED STATES PATENT AND TRADEMARK OFFICE

CERTIFICATE OF CORRECTION

PATENT NO. : 5,667,089

DATED : September 16, 1997

INVENTOR(S) : David N. Moore

It is certified that error appears in the above-indentified patent and that said Letters Patent is hereby corrected as shown below:

Column 6, line 37, please replace "skin" with --skirt--.

Signed and Sealed this

Twenty-third Day of March, 1999

*Attest:*

*Attesting Officer*

Q. TODD DICKINSON

*Acting Commissioner of Patents and Trademarks*